US005644994A

United States Patent [19]

Liang et al.

[11] Patent Number: 5,644,994

[45] Date of Patent: Jul. 8, 1997

[54] FOLDING COLLAPSIBLE TABLE

[76] Inventors: Chao-C Liang; Chao-Ming Liang, both of No. 15, Lane 35, San Min Rd., Hsin-Tien City, Taipei County, Taiwan

[21] Appl. No.: 700,105

[22] Filed: Aug. 20, 1996

[51] Int. Cl.[6] ..... A47B 3/02

[52] U.S. Cl. ..... 108/116; 108/115

[58] Field of Search ..... 108/114, 116, 108/115, 128, 174, 175, 173, 162, 106, 144; 211/187, 149, 193, 195, 200, 201, 204, 172

[56] References Cited

U.S. PATENT DOCUMENTS

| | | | |
|---|---|---|---|
| 2,692,175 | 10/1954 | Jacques . | |
| 2,857,228 | 10/1958 | Koett | 108/115 |
| 2,938,632 | 5/1960 | Mondineu | 108/116 X |
| 3,104,626 | 9/1963 | Brunette | 108/106 |
| 3,371,797 | 3/1968 | Caligiuri | 211/204 |
| 3,436,092 | 4/1969 | Werner | 108/115 X |
| 4,251,044 | 2/1981 | Olson | 108/115 X |
| 5,080,024 | 1/1992 | Yamamoto | 108/116 |
| 5,337,657 | 8/1994 | Diffrient | 108/115 |
| 5,417,168 | 5/1995 | Soper | 108/116 X |

FOREIGN PATENT DOCUMENTS

| | | | |
|---|---|---|---|
| 466632 | 6/1937 | United Kingdom | 108/115 |

*Primary Examiner*—Jose V. Chen

*Attorney, Agent, or Firm*—Morton J. Rosenberg; David I. Klein

[57] ABSTRACT

A folding collapsible table including two stands connected in parallel by a folding connecting plate, two L-shaped extension supports respectively inserted into the stands and locked at the desired elevation by a respective lock, and a folding table plate turned about the horizontal top extension rod of one L-shaped extension support, the folding table plate having grooved coupling plates at the bottom detachably forced into engagement with the horizontal top extension rods of the L-shaped extension supports for permitting the folding table plate to be supported on the horizontal top extension rods of the L-shaped extension supports for serving.

1 Claim, 4 Drawing Sheets

FOLDING COLLAPSIBLE TABLE

BACKGROUND OF THE INVENTION

The present invention relates to tables, and relates more particularly to a folding collapsible table which can be conveniently adjusted to the desired height when in use, or folded up into a collapsed condition for storage.

When going to the outside for an outdoor activity, it is difficult to find a place for writing or placing things. There are movable furniture specifically designed for use outdoors. However, these movable articles commonly need much storage space. Furthermore, these movable articles cannot be adjusted to the desired height to fit different users.

SUMMARY OF THE INVENTION

It is one object of the present invention to provide a portable table which can be conveniently folded up and collapsed when not in use. It is another object of the present invention to provide a folding collapsible table which can be conveniently adjusted to the desired height. According to the preferred embodiment of the present invention, the folding collapsible table comprises two stands connected in parallel by a folding connecting plate, two L-shaped extension supports respectively inserted into the stands and locked at the desired elevation by a respective lock, and a folding table plate turned about the horizontal top extension rod of one L-shaped extension support, the folding table plate having grooved coupling plates at the bottom detachably forced into engagement with the horizontal top extension rods of the L-shaped extension supports for permitting the folding table plate to be supported on the horizontal top extension rods of the L-shaped extension supports for serving.

DETAILED DESCRIPTION OF THE PREFERRED EMBODIMENT

Figure 1:
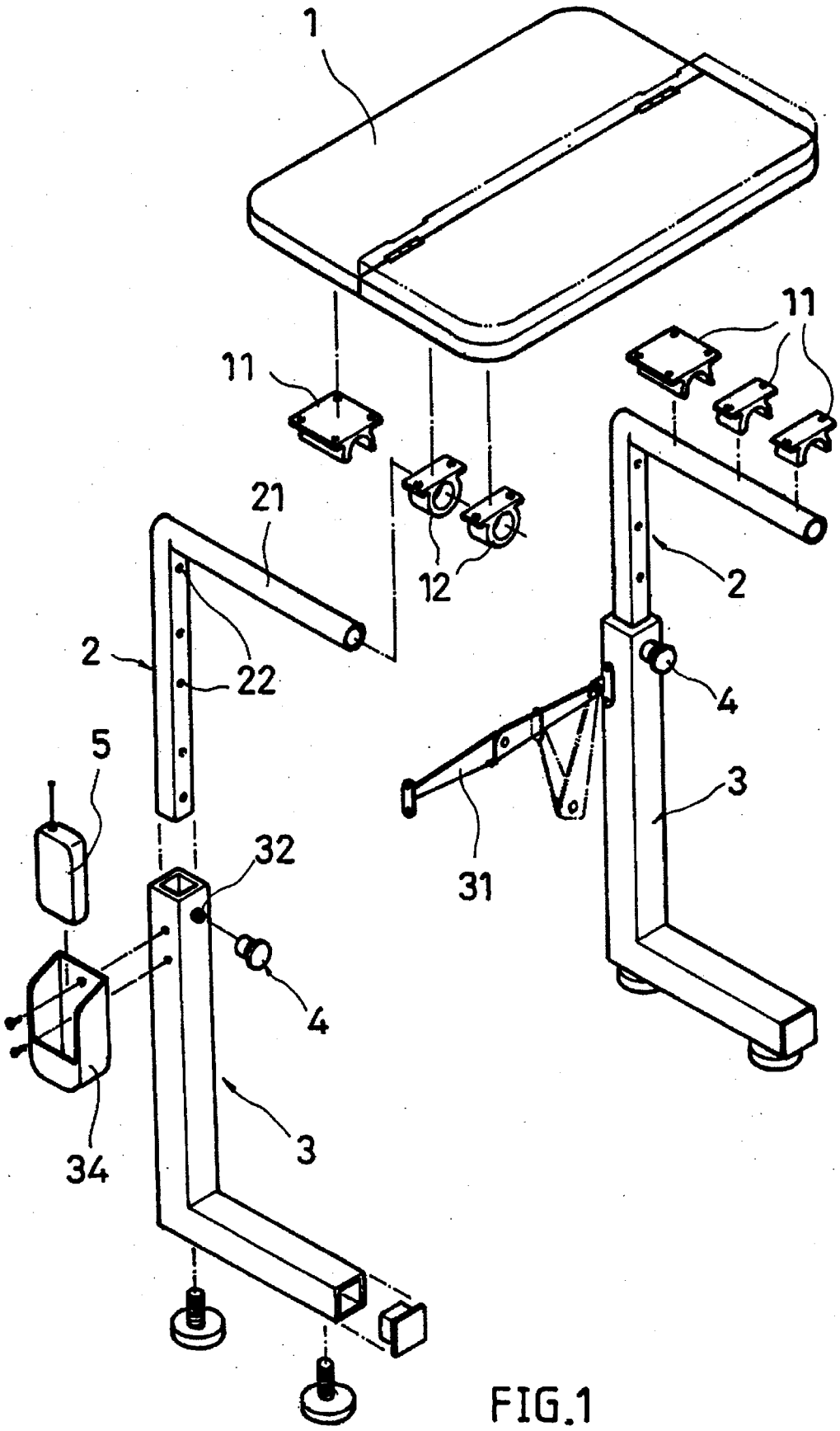
FIG. 1 is an exploded view of a folding collapsible table according to the present invention.
Figure 2:
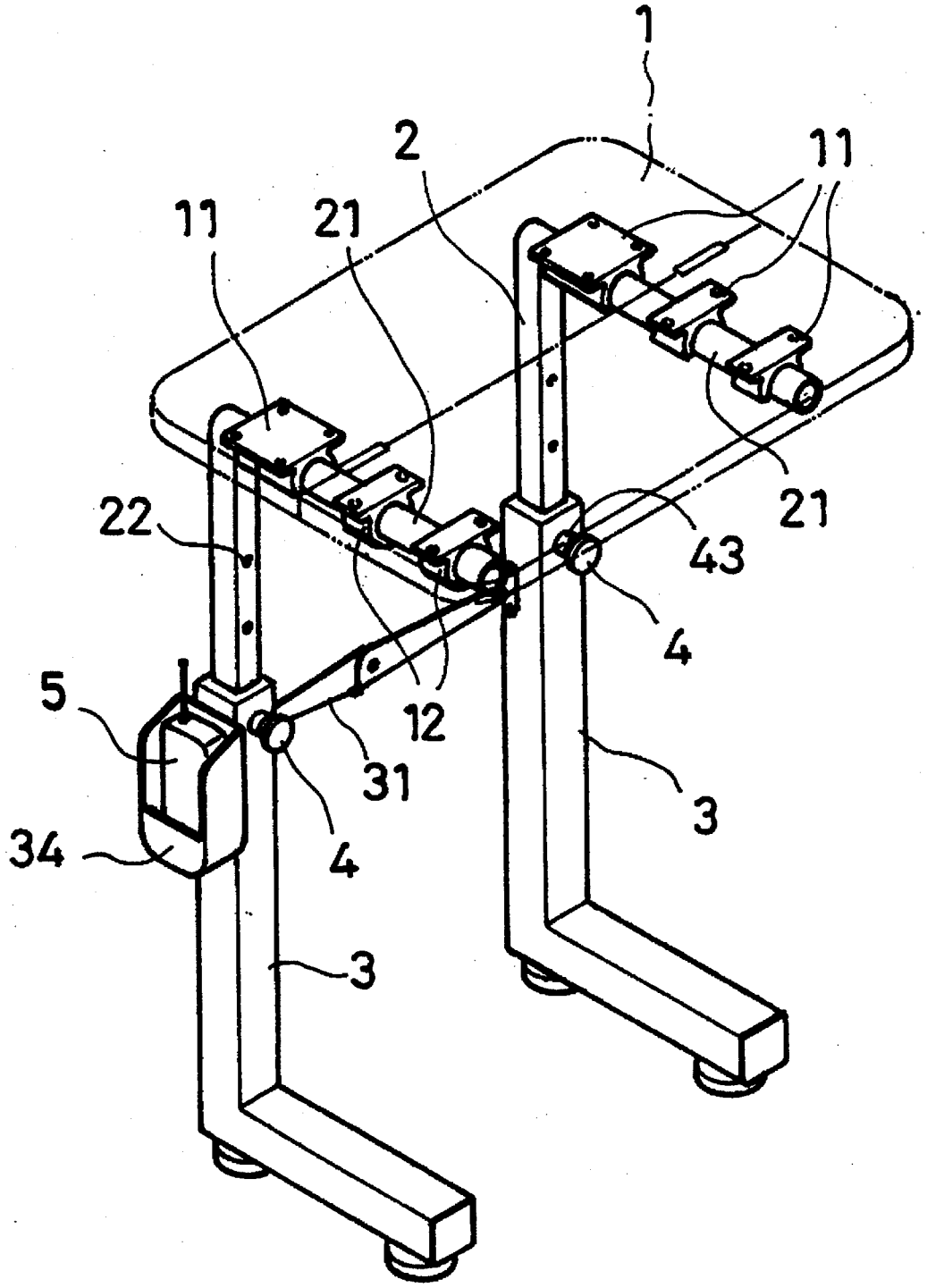
FIG. 2 is an elevational view of the folding collapsible table shown in FIG. 1.
Figure 3:
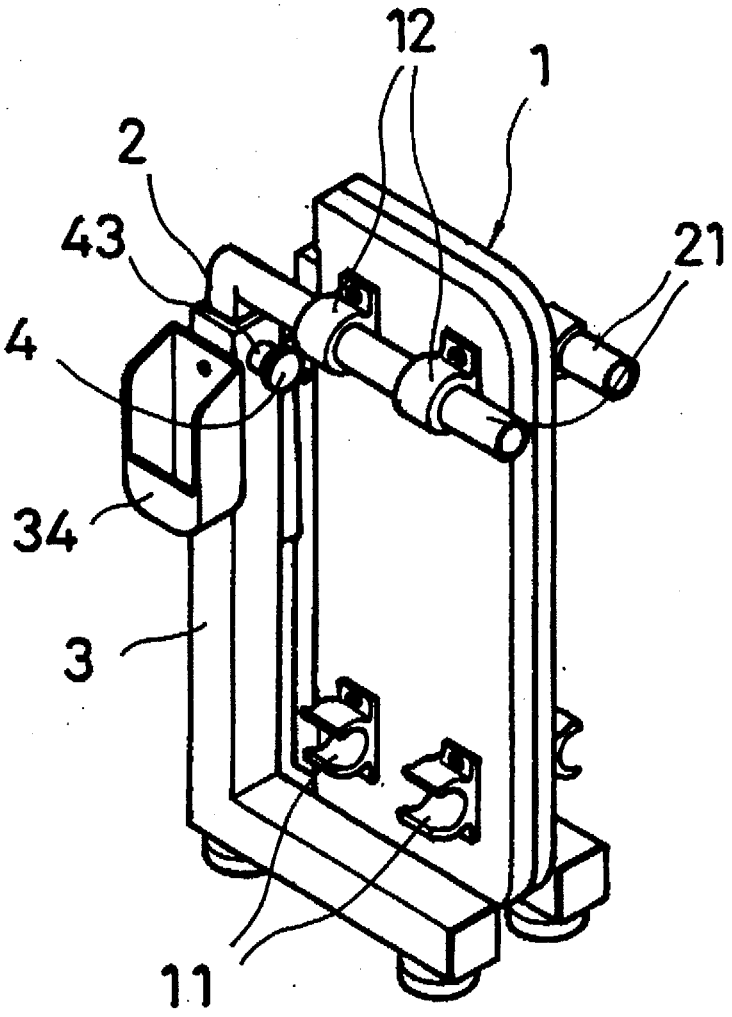
FIG. 3 shows the folding collapsible table of the present invention collapsed.

Referring to FIGS. 1, 2, and 3, a folding collapsible table in accordance with the present invention is generally comprised of a folding collapsible table plate 1, two stands 3, and two extension supports 2. The folding collapsible table can be arranged between the operative position shown in FIG. 2, and the collapsed position shown in FIG. 3. The stands 3 are made from hollow bars and connected in parallel by a folding connecting plate 31, each having a radial pin hole 33 near the top and an externally threaded annular flange 32 raised from the outside wall around the radial pin hole 33 (see also FIG. 4). The extension supports 2 are respectively inserted into the stands 3 from the top. Each extension support 2 comprises a vertically spaced series of lock holes 22 adjustably connected to the pin hole 33 of one stand 3 by a lock (this will be described further), and a horizontal extension rod 21 at the top. The folding collapsible table plate 1 is comprised of two symmetrical halves hinged together, having a plurality of first coupling plates 11 and a second coupling plate 12 arranged in two lines at the bottom. The first coupling plates 11 can be forced into engagement with the horizontal extension rods 21 of the extension supports 2 from the top, and disconnected from the horizontal extension rods 21 of the extension supports 2 by an upward pulling force. The second coupling plate 12 is made in the form of a barrel, and sleeved onto the horizontal extension rod 21 of one extension support 2. when the second coupling plate 12 is sleeved onto the horizontal extension rod 21 of one extension support 2, the folding collapsible table plate 1 can be turned about the corresponding horizontal extension rod 21. Further, a case 34 may be fastened to one stand 3 at one side for holding a mobile telephone 5.

Figure 4:
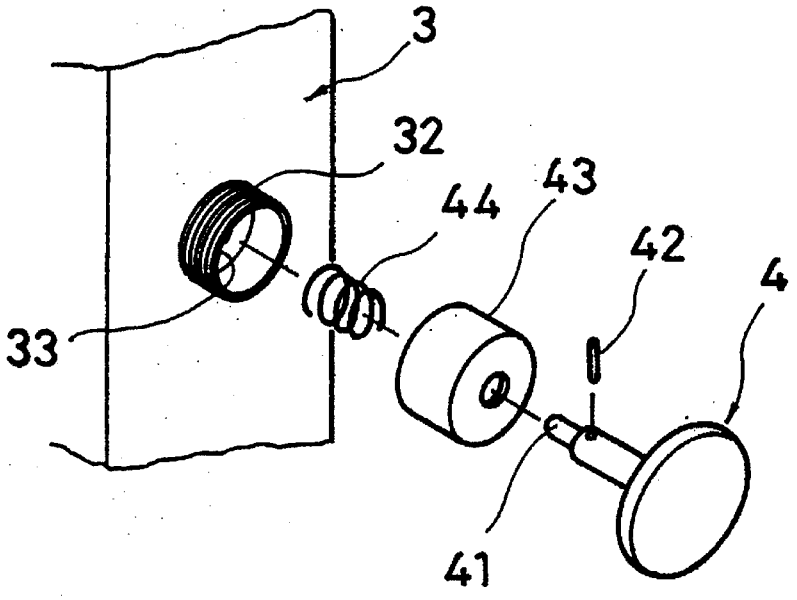
FIG. 4 is an exploded view of a part of the present invention, showing the structure of the lock.
Figure 4A:
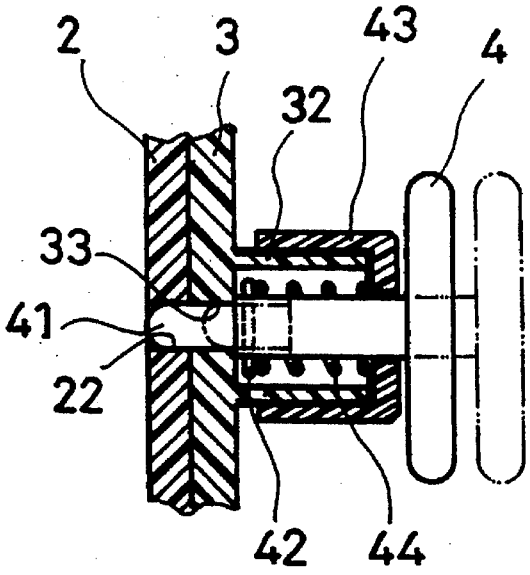
FIG. 4*a* is sectional view of FIG. 4, showing the lock installed, the extension support locked.

Referring to FIGS. 4 and 4-1, the aforesaid lock comprises an internally threaded cup 43 threaded onto the externally threaded annular flange 32 of one stand 3, a knob 4 mounted in the center hole of the internally threaded cup 43 and having a lock pin 41 at the front side inserted through the pin hole 33 of the corresponding stand 3 into one lock hole 22 of the corresponding extension support 2, a locating pin 42 fastened to the knob 4 in the middle and disposed outside the corresponding stand 3 within the internally threaded cup 43, and a spring 44 mounted around the knob 4 and connected between the locating pin 42 and the inside wall of the internally threaded cup 43.

Referring to FIGS. 4-1 and FIG. 2 again, when the knob 4 is pulled outwards to release the lock pin 41 from the lock holes 22 of the corresponding extension support 2, the corresponding extension support 2 is allowed to be moved vertically in the corresponding stand 3 to adjust the elevation of the folding collapsible table plate 1.

Referring to FIGS. 2 and 3 again, when the folding collapsible table plate 1 is turned upwards to disengage the first coupling plates 11 from the horizontal extension rods 21 of the extension supports 2, the folding collapsible table plate 1 can then be folded up. When the folding collapsible table plate 1 is folded up, the folding connecting plate 31 is folded up, permitting the stands 3 to be closely attached to each other, and therefore the folding collapsible table is arranged into the collapsed position as shown in FIG. 3.

It is to be understood that the drawings are designed for purposes of illustration only, and are not intended as a definition of the limits and scope of the invention disclosed.

What the invention claimed is:

1. A folding collapsible table comprising:

two stands respectively made from hollow bars, each of said stands having a radial pin hole near a top end thereof, and an externally threaded annular flange extending from an outside surface thereof around said radial pin hole;

a folding connecting plate connected on opposing ends to each of said stands for holding said stand in spaced parallel relationship;

two extension supports respectively inserted into said two stands, each of said extension supports having a plurality of vertically spaced lock holes formed therein for selective alignment with the pin hole of the respective stand, each of said extension supports having a horizontal extension rod disposed at a top end thereof;

two locks respectively mounted on the externally threaded annular flanges of said stands for releasably coupling said extension supports in said stands, each of said locks including (a) an internally threaded cup threaded onto the externally threaded annular flange of a respective stand and having a centrally disposed hole formed therethrough, (b) a knob mounted in the center hole of said internally threaded cup and having a lock pin extending from a front side thereof adapted for insertion through the pin hole of the corresponding stand into a selected one of said plurality of lock holes of the corresponding extension support, (c) a locating pin fastened to said knob in an intermediate portion thereof and disposed outside the corresponding stand within said internally threaded cup, and (d) a spring mounted around said knob and connected between said locating pin and an inside wall of said internally threaded cup; and a folding table plate adapted to be supported on the horizontal extension rods of said extension supports, said folding table plate including (a) first and second symmetrical halves hingedly coupled together, (b) a plurality of first coupling plates secured to a bottom side of opposing ends of said first symmetrical half and a bottom side of a first end of said second symmetrical half, each of said plurality of first coupling plates being releasably engageable with a respective horizontal extension rod to support said folding table plate thereon and be removable therefrom, and (c) a second coupling plate secured to a second end of said second symmetrical half on a bottom side thereof, said second coupling plate having a closed annular contour and being sleeved onto the horizontal extension rod of one extension support for permitting said folding table plate to be rotated about the corresponding horizontal extension rod subsequent to disengagement of said plurality of first coupling plates form said horizontal extension rods and folding of said first symmetrical half with respect to said second symmetrical half.

* * * * *